US010088763B2

(12) United States Patent
Sakai et al.

(10) Patent No.: US 10,088,763 B2
(45) Date of Patent: Oct. 2, 2018

(54) ELECTROSTATIC CHARGE IMAGE DEVELOPER, DEVELOPER CARTRIDGE, AND PROCESS CARTRIDGE

(71) Applicant: FUJI XEROX CO., LTD., Tokyo (JP)

(72) Inventors: Motoko Sakai, Kanagawa (JP); Shuji Sato, Kanagawa (JP); Shintaro Anno, Kanagawa (JP); Takuro Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/217,332

(22) Filed: Jul. 22, 2016

(65) Prior Publication Data

US 2017/0255116 A1 Sep. 7, 2017

(30) Foreign Application Priority Data

Mar. 4, 2016 (JP) ..... 2016-041888

(51) Int. Cl.

| | |
|---|---|
| ***G03G 9/09*** | (2006.01) |
| ***G03G 9/08*** | (2006.01) |
| ***G03G 15/08*** | (2006.01) |
| ***G03G 9/113*** | (2006.01) |

(52) U.S. Cl.

CPC ..... *G03G 9/0819* (2013.01); *G03G 9/0902* (2013.01); *G03G 9/1133* (2013.01); *G03G 15/0865* (2013.01)

(58) Field of Classification Search

CPC ... G03G 9/0902; G03G 9/1075; G03G 9/1133
See application file for complete search history.

(56) References Cited

U.S. PATENT DOCUMENTS

| | | | | |
|---|---|---|---|---|
| 5,631,116 | A * | 5/1997 | Uchida | G03G 9/1133 428/407 |
| 2011/0318063 | A1 | 12/2011 | Takahashi et al. | |
| 2011/0318682 | A1 | 12/2011 | Takahashi et al. | |
| 2011/0318683 | A1* | 12/2011 | Kadokura | G03G 9/0819 430/105 |
| 2014/0045113 | A1* | 2/2014 | Takahashi | G03G 9/08755 430/105 |

FOREIGN PATENT DOCUMENTS

| | | | |
|---|---|---|---|
| JP | H06-43697 | A | 2/1994 |
| JP | H06-43698 | A | 2/1994 |
| JP | H07-114219 | A | 5/1995 |
| JP | 2009-258700 | A | 11/2009 |

(Continued)

OTHER PUBLICATIONS

Aug. 1, 2017 Office Action issued in Japanese Patent Application No. 2016-041888.

*Primary Examiner* — Peter L Vajda
(74) *Attorney, Agent, or Firm* — Oliff PLC

(57) ABSTRACT

An electrostatic charge image developer includes a brilliant toner that includes a toner particle having an average equivalent circle diameter D longer than an average maximum thickness C and a carrier that includes a core particle and a coating layer which covers a surface of the core particle, wherein the coating layer contains a resin and a surfactant, and a content of the surfactant is in a range of 50 ppm to 200 ppm with respect to the entire weight of the carrier.

10 Claims, 2 Drawing Sheets

(56) References Cited

FOREIGN PATENT DOCUMENTS

| | | | |
|---|---|---|---|
| JP | 2010-026259 | A | 2/2010 |
| JP | 2012-022156 | A | 2/2012 |
| JP | 2012-032765 | A | 2/2012 |
| JP | 2012-068522 | A | 4/2012 |
| JP | 2014-164128 | A | 9/2014 |
| JP | 2014-174454 | A | 9/2014 |
| JP | 2015-79156 | A | 4/2015 |
| JP | 2015-084050 | A | 4/2015 |
| JP | 2016-018046 | A | 2/2016 |
| JP | 2016-151712 | A | 8/2016 |
| JP | 2016-170216 | A | 9/2016 |

* cited by examiner

ELECTROSTATIC CHARGE IMAGE DEVELOPER, DEVELOPER CARTRIDGE, AND PROCESS CARTRIDGE

CROSS-REFERENCE TO RELATED APPLICATIONS

This application is based on and claims priority under 35 USC 119 from Japanese Parent Application No. 2016-041888 filed Mar. 4, 2016.

BACKGROUND

1. Technical Field

The present invention relates to an electrostatic charge image developer, a developer cartridge, and a process cartridge.

2. Related Art

A method of visualizing image information through an electrostatic charge image obtained by using an electrophotography method and the like has been used in various technical fields.

In the related art, in the electrophotography method, a method of visualizing through plural steps, such as a step of forming an electrostatic latent image on an image holding member such as a photoreceptor and an electrostatic recording medium by using various units, a step of developing the electrostatic latent image (a toner image) by attaching a detective particle which is called a toner to the electrostatic latent image, a step of transferring the developed image onto a surface of a transfer medium, and a step of fixing the image by heat or the like has been generally used.

Among the toners, a brilliant toner is used for the purpose of forming an image having brilliance such as a metallic luster.

SUMMARY

According to an aspect of the invention, there is provided an electrostatic charge image developer including:

a brilliant toner that includes a toner particle having an average equivalent circle diameter D longer than an average maximum thickness C; and a carrier that includes a core particle and a coating layer which covers a surface of the core particle, wherein the coating layer contains a resin and a surfactant, and a content of the surfactant is in a range of 50 ppm to 200 ppm with respect to the entire weight of the carrier.

BRIEF DESCRIPTION OF THE DRAWINGS

Exemplary embodiments of the present invention will be described in detail based on the following figures, wherein.

DETAILED DESCRIPTION

Figure 1:
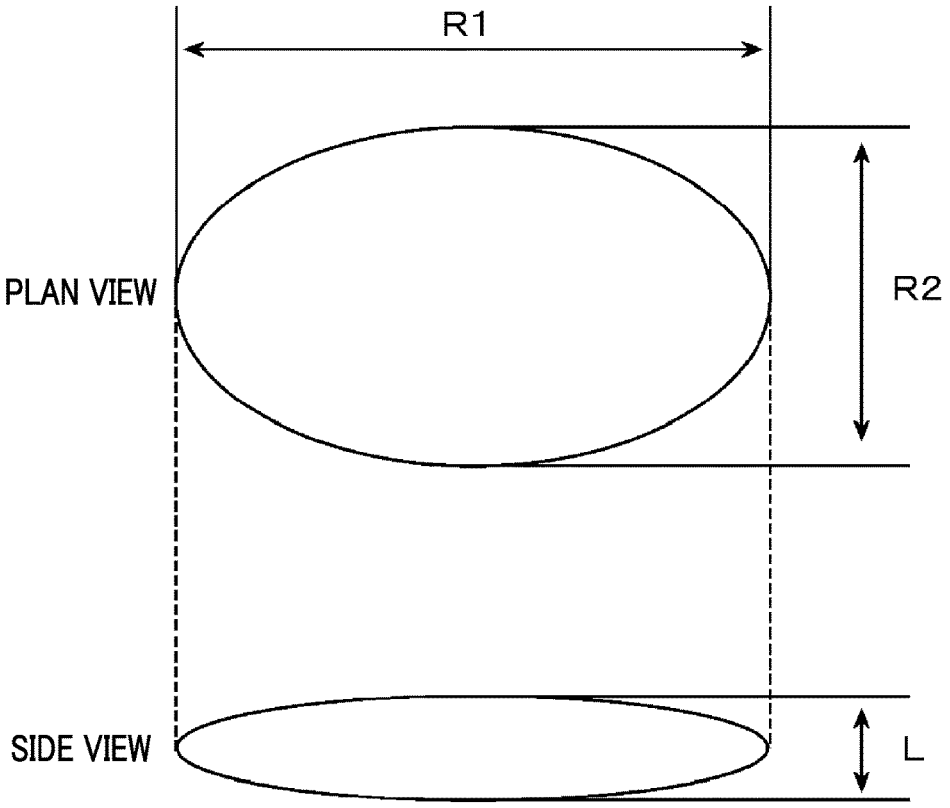
FIG. 1 is a plane view and a side view illustrating an example of a brilliant toner which is preferably applicable to the exemplary embodiment.

Hereinafter, the exemplary embodiments will be described.

Note that, in the exemplary embodiment, the description of "A to B" indicates not only a range of A to B, but also a range including A and B which are both ends of the range. For example, if the description of "A to B" indicates a numerical range, the numerical range is indicated by "a range of A to B" or "a range of B to A".

Electrostatic Charge Image Developer

The electrostatic charge image developer (hereinafter, simply referred to as a "developer") according to the exemplary embodiment includes a brilliant toner including a toner particle having an average equivalent circle diameter D longer than an average maximum thickness C, a carrier including a coating layer which covers core particles and the surfaces of core particles, in which the coating layer contains a resin and a surfactant, and the content of the surfactant is in a range of 50 ppm to 200 ppm with respect to the entire weight of the carrier.

Note that, a phrase "having brilliance" in the exemplary embodiment means that an image forced from the brilliant toner according to this exemplary embodiment has brightness such as metallic, luster, when being visually confirmed.

Note that, the phrase "brightness such as metallic luster" means that when a solid image is formed by using the brilliant toner, a ratio (A/B) of a reflectance A at a light-receiving angle of +30° to a reflectance B at a light-receiving angle of −30°, which are measured when the image is irradiated with incident light at an incident angle of −45° by a goniophotometer with respect to the image, is in a range of 2 to 100.

As a result of the intensive studies of the present inventors, it is found that the brilliant toner including the toner particle having the average equivalent circle diameter D which is longer than the average maximum thickness C is in a unstable slave on a recording medium before being fixed as compared with a spherical toner, and the arrangement of toners is disordered when the moisture which is attached on the surface of the recording medium and/or is contained in the recording medium is evaporated at the time of fixation, thereby causing the occurrence of the color unevenness on the image.

As a result of the intensive studies of the present inventors, it is also found that in a case of using the brilliant toner including the toner particle having the average equivalent circle diameter D which is longer than the average maximum thickness C, it is possible to form an image having less color unevenness by allowing the coating layer of a coating carrier to have a specific amount of surfactant, and thereby the present invention is completed.

The specific mechanism is not clear, but estimation is performed as follows.

When the brilliant toner conflicts with the carrier, the surfactant is suctioned into the surface of the carrier, and then migrates on the surface of the brilliant toner. For this reason, it is estimated that the affinity between water and water vapor can be improved in the recording medium at the time of fixation, and the arrangement of brilliant toners is not disordered, thereby obtaining an image having less color unevenness.

Carrier

The carrier which is used for electrostatic charge image developer according to the exemplary embodiment includes a coating layer which coats core particles and the surface of the core particles, the coating layer contains a resin and a surfactant, and the content of the surfactant is in a range of 50 ppm to 200 ppm with respect to the entire weight of the carrier.

Core Particles

As a material forming the core particles, a magnetic material is preferably used, and examples thereof include magnetic metal such as iron, steel, nickel, and cobalt; an alloy of these magnetic metals, manganese, chromium, and a rare earth; and magnetic oxide such as ferrite and magnetite.

The core particles are obtained by magnetic granulation and sintering, font as the pre-treatment thereof, the magnetic material may be pulverized. A pulverizing method is not particularly limited, and examples thereof specifically include a well-known pulverizing method such as a method performed by using a mortar, a ball mill, a jet mill, and the like.

The volume average particle diameter of the core particles is preferably in a range of 10 μm to 500 μm, is further preferably in a range of 20 μm to 100 μm, and is particularly preferably in a range of 20 μm to 40 μm.

The volume average particle diameter of the core particles is measured by using a laser diffraction type particle size distribution measuring device.

Coating Layer

The coating layer in the carrier contains a resin (hereinafter, also referred to as a "coating resin"), a surfactant, and other additives if necessary.

The coating layer does not contain other additives, that is, the coating layer is preferably a layer formed of the resin and the surfactant. With this configuration, the obtained image has less color unevenness.

Coating Resin

Examples of the coating resin include an acrylic resin, a polyethylene resin, a polypropylene resin, a polystyrene resin, a polyacrylonitrile resin, a polyvinyl acetate resin, a polyvinyl alcohol resin, a polyvinyl butyral resin, a polyvinyl chloride resin, a polyvinyl carbazole resin, a polyvinyl ether resin, a polyvinyl ketone resin, a vinyl chloride-vinyl acetate copolymer, a styrene-acrylic acid copolymer, a straight silicone resin configured to include an organosiloxane bond or a modified product thereof, a fluorine resin, a polyester resin, a polyurethane resin, a polycarbonate resin, a phenolic resin, an amino resin, a melamine resin, a benzoguanamine resin, a urea resin, an amide resin, and an epoxy resin.

Among them, as the resin forming the coating layer, it is preferable to contain a resin containing a cycloalkyl (meth) acrylate as a polymerization component, that is, an acrylic resin having a cycloalkyl group.

Examples of the acrylic resin having a cycloalkyl group include a homopolymer of cycloalkyl (meth)acrylate, and copolymer of cycloalkyl (meth)acrylate with other homopolymer.

Examples of the cycloalkyl (meth)acrylate include cyclopentyl acrylate, cyclopentyl methacrylate, cyclohexyl acrylate, cyclohexyl methacrylate, cyclooctyl acrylate, and cyclooctyl methacrylate.

Among them, as the cycloalkyl (meth)acrylate, the cyclohexyl acrylate, and/or the cyclohexyl methacrylate are/is preferably used, and the cyclohexyl methacrylate is particularly preferably used.

In addition, the acrylic resin having a cycloalkyl group preferably has equal to or greater than 80% by weight of a constituent unit derived from the cycloalkyl (meth)acrylate, with respect to the entire resins.

The weight average molecular weight of the coating resin is preferably in a range of 5,000 to 1,000,000, and is further preferably in a range of 10,000 to 200,000.

The coverage rate of the coating layer is preferably equal to or greater than 80%, and is further preferably equal to or greater than 30% with respect to the surfaces of the core particles.

The coverage rate indicates a degree of coverage of the coating resin with respect to the surfaces of the core particles, and is preferably equal to or less than 20%, and is further preferably equal to or less than 10% when elements (for example, iron) measured by elemental analysis in a portion which is not covered in the fluorescent X-ray measurement are irradiated with light in a wider range (for example, approximately ⅓ to ⅔ with respect to a projected area for one carrier).

Surfactant

Examples of the surfactant include an anionic surfactant, a cationic surfactant, and a nonionic surfactant, and as the surfactant, a solid compound at 25° C. is preferably used, the anionic surfactant or the cationic surfactant is preferably used, and the anionic surfactant is further preferably used. With such a configuration, it is likely that the obtained image has less color unevenness.

In addition, in the electrostatic charge image developer according to the exemplary embodiment, it is preferable that the brilliant toner also contains the surfactant, it is further preferable that both of a surfactant contained in the brilliant toner and a surfactant contained in the coating layer are anionic surfactants, and it is particularly preferable that the surfactant contained in the brilliant toner and the surfactant contained in the coating layer are the same type of surfactants. With such a configuration, it is likely than the obtained image has less color unevenness.

Examples of the anionic surfactant include a compound obtained by substituting sulfonate with an alkyl group or a phenyl group such as sodium dodecyl benzene sulfonate and alkyl diphenyl ether sodium disulfonate, metal soaps such as lithium stearate, magnesium stearate, calcium stearate, barium stearate, zinc stearate, calcium ricinoleate, barium ricinoleate, zinc ricinoleate, and zinc octylate, and alkyl sulfate esters such as sodium lauryl sulfate, potassium lauryl sulfate, sodium myristyl sulfate, and sodium cetyl sulfate.

Examples of the cationic surfactant include amine acetic acids such as octadecylamine acetate and tetradecyl amine acetate, methyl ammonium hydrochloride salts such as lauryl trimethyl ammonium chloride, tallow trimethyl, ammonium chloride, cetyl trimethyl ammonium chloride, stearyl trimethyl ammonium chloride, behenyl trimethyl ammonium chloride, distearyl dimethyl ammonium chloride, and didecyl dimethyl ammonium chloride, methyl ammonium hydrochloride salts, benzyl chlorides such as octadecyl dimethyl benzyl ammonium chloride and tetradecyl dimethyl benzyl ammonium chloride, and dioleyl dimethyl ammonium chloride.

Examples of the nonionic surfactant include butyl stearate, stearyl stearate, butyl laurate, lauryl laurate, isopropyl myristate, octyl palmitate, glycerol monostearyl ether, glutaric serine mono cetyl ether, glutaric serine mono oleyl ether, batyl monostearate, batyl monoisostearate, glyceryl monostearate, glyceryl monooleate, glyceryl distearate, and glyceryl dioleate.

The surfactant may be used singly or in combination of two or more types thereof.

The content of the surfactant is in a range of 50 ppm to 200 ppm with respect to the entire weight of the carrier in the coating layer, is preferably equal to or greater than 50 ppm and less than 150 ppm, and is particularly preferably in a range of 60 ppm to 100 ppm. When the content thereof is in the above-described range, it is likely that the obtained image has less color unevenness.

The content of the surfactant is obtained by using a method with a liquid chromatography-mass spectrometry (LC/MS) apparatus (manufactured by Waters Corporation, ACQUITY UPLC/LCT-Premier/column: manufactured by Waters Corporation, ACQUITY UPLC BEH C8)/detector: photodiode array detector (PDA) (Detection wavelength of 210 nm to 500 nm) and MS (Negative, LC measurement solution: 60% aqueous acetonitrile solution). Specifically, 10 ml solution (60% aqueous acetonitrile solution) is added to 5 g carrier, the solution is kept to stand for one night, and then with the solution, a peak of the surfactant is subjected to the measurement of the liquid chromatography-mass spectrometry (LC/MS). A calibration curve of the content of the surfactant is created by attributing the composition from data while measuring the surfactant corresponding to the data of concentration. On the basis of the calibration curve, the content of the surfactant with respect to the carrier particles is obtained.

Coverage Amount

The amount of the coating layer (coverage amount) in the carrier is preferably in a range of 1% by weight to 10% by weight with respect to the entire weight of the core particles, is further preferably in a range of 3% by weight to 5% by weight, and is particularly preferably in a range of 3.5% by weight to 4.5% by weight.

The measurement of the coverage amount is performed in such a manner that 2 g carrier and 20 ml toluene are put into 100 ml beaker, the mixture is treated for 10 minutes by using ultrasonic cleaner (manufactured by Sharp Corporation: UT-105) at 100% power, and the supernatant is removed in a state where the carrier is fixed to the lower portion of the beaker by using magnet. After repeatedly performing this treatment three times, the residue is dried to measure the weight thereof, reduced amount from the initial weight is obtained, and the reduced amount is determined as the coverage amount.

Physical Properties of Carrier

The fluidity of the carrier used in the exemplary embodiment is preferably 25 sec/50 g to 55 sec/50 g at 25° C. and 50% RH (relative humidity), is further preferably in a range of 30 sec/50 g to 50 sec/50 g, and is particularly preferably in a range of 40 sec/50 g to 45 sec/50 g. When the fluidity thereof is in the above-described range, it is likely that the obtained image has less color unevenness.

The measurement of the fluidity in the exemplary embodiment is performed based on JIS-Z2502 (2000).

The volume average particle diameter of the carrier is preferably in a range of 10 μm to 500 μm, is further preferably in a range of 20 μm to 100 μm, and is particularly preferably in a range of 20 μm to 40 μm.

The volume average particle diameter of the carrier is measured by using a laser diffraction type particle size distribution measuring device.

The volume resistivity (25° C.) of the carrier is preferably in a range of $1\times10^{7}$ Ω·cm to $1\times10^{15}$ Ω·cm, is further preferably in a range of $1\times10^{8}$ Ω·cm to $1\times10^{14}$ Ω·cm, and is particularly preferably in a range of $1\times10^{8}$ Ω·cm to $1\times10^{13}$ Ω·cm.

Method of Preparing Carrier

The carrier used in the exemplary embodiment is prepared through the steps such as a step of imparting mechanical impact to the core particles and the particles of the coating resin so as to obtain a mixture obtained by attaching the particles of the coating resin co the surfaces of the core particles, a step of kneading the mixture, and a step of pulverizing the kneaded mixture by imparting the mechanical impact again. With this, the surfaces of the core particles are coated with the coating layer, thereby preparing the carrier.

The mechanical impact is imparted, by preferably using a well-known dry treatment device such as NOBIRUTA (manufactured by Hosokawa Micron Co., Ltd.), VERTICAL GRANULATOR (manufactured by Powrex Corp.), and HENSCHEL MIXER (manufactured by Shimadzu Corporation).

On the other hand, the mixture is kneaded by preferably using a well-known kneader such as a uniaxial kneader and a twin screw kneader.

Here, in the method of preparing the carrier, the introduction source supplied to the coating layer of the surfactant may be a surfactant which is used at the time synthesizing the coating resin. That is, the surfactant may be mixed into coating layer by forming the coating layer with the coating resin obtained by synthesizing by using the surfactant. Specifically, the particles of the coating resin are prepared by using a wetting method using a surfactant (for example, an emulsion polymerization method, and a suspension polymerization method), and by using these particles of the coating resin, the coating layer is preferably formed through the above-described method. In addition, in this case, the content of the surfactant of the coating layer is adjusted in response to the additive amount of the surfactant to be used.

Note that, the mixing of the surfactant into the coating layer may be performed by additionally adding the surfactant to the coating resin when the coating layer is formed. Specifically, for example, the surfactant may foe mixed into the coating layer in such a manner that the surfactant is added to a lump coating resin, the resultant is kneaded and pulverized so as to obtain the particles of the coating resin, and then the coating layer is formed by using the particles of the coating resin.

The mixing ratio (weight ratio) of the toner to the carrier in the electrostatic charge image developer according to the exemplary embodiment is preferably in a range of toner: carrier=1:100 to 30:100, and is further preferably in a range of 3:100 to 20:100.

Brilliant Toner

The brilliant toner (simply, also referred to as "toner") used for the electrostatic charge image developer according to the exemplary embodiment includes toner particles having an average equivalent circle diameter D longer than an average maximum thickness C.

In a flat surface in which the projected area is the maximized surface, an equivalent circle diameter M is obtained by the following expression when the projected area is set as X.

$$M=2\times(X/\pi)^{1/2}$$

It is preferable that the brilliant toner further satisfies the following condition (1).

(1) When a cross section of the toner particle in a thickness direction is observed, the ratio of the metallic pigments, in which an angle between a long axis direction of the toner particle in the cross section and a long axis direction of the metallic pigment is from −30° to +30°, is 70% or greater of the total number of metallic pigments that are observed.

Figure 2:
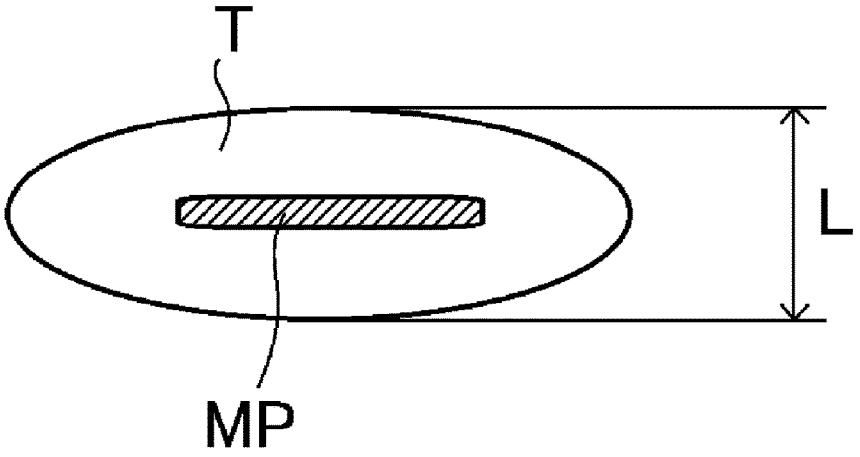
FIG. 2 is schematic sectional view illustrating an example of the brilliant toner which is preferably applicable to the exemplary embodiment.

In this regard, FIG. 2 illustrates a schematic sectional view illustrating an example of the toner particles in the brilliant toner which satisfies the above condition (1) and is preferably used in the exemplary embodiment. Note that, the schematic view illustrated in FIG. 2 is a sectional view of the toner particle in the thickness direction.

A toner particle T illustrated in FIG. 2 is a toner particle having a flat shape (specifically, scaly) and having the equivalent circle diameter which is longer than a thickness L, and contains a metallic pigment MP.

Average maximum thickness C and average equivalent circle diameter D of toner particle.

As described above, the toner particle has a flat shape. That is, a value of the average maximum thickness C is smaller than a value of the average equivalent circle diameter D of toner particle.

In addition, a value of the ratio (C/D) in the toner particle is preferably from 0.001 to 0.700, more preferably from 0.001 to 0.500, further preferably from 0.010 to 0.200, and is still further preferably from 0.050 to 0.100. When the ratio (C/D) is equal to or greater than 0.001, toner particle strength is secured and a fracture that is caused due to a stress in the image formation is thus prevented, so that a reduction in charges that is caused by exposure of the pigment from the toner particle, and fogging that is caused as a result thereof are prevented. On the other hand, when the ratio (C/D) is equal to or less than 0.700, it is likely that excellent brilliance is obtained as compared with the case where the ratio (C/D) is equal to or greater than 0.700.

The average maximum thickness C and the average equivalent circle diameter D are measured by the following method.

A toner is placed on a smooth surface and uniformly dispersed by applying vibrations. 100 toner particles are observed with a color laser microscope "VK-9700" (manufactured by Keyence Corporation) at a magnification of 1,000 times to measure a maximum thickness C and an equivalent circle diameter D calculated by the projected area of a surface viewed from the top, and arithmetic average values thereof are obtained to calculate the average maximum thickness C and the average equivalent circle diameter D.

In addition, similarly, an average long axis length and an average short axis length (for example, R1 and R2 as illustrates in FIG. 1) are calculated in such a manner that 100 toner particles are observed with a color laser microscope "VK-9700" (manufactured by Keyence Corporation) at a magnification of 1,000 times to measure the long axis length and the short axis length, and arithmetic averages thereof.

In the exemplary embodiment, as described above, it is considered that the flat toner particles are arranged by the physical force from the fixing member such that the flat surface side thereof faces the surface of the recording medium (in the almost parallel direction), in the fixing step.

As described in the above-description (1), regarding the toner particle, when a cross section of the toner particle in a thickness direction is observed, the number of metallic pigments (also referred to as "the number of flat pigments") that are present so that an angle between a long axis direction of the toner particle in the cross section and a long axis direction of the metallic pigment is from −30° to +30° is equal to or greater than 70% by number of the total metallic pigments that are observed.

The toner particle T as illustrated in FIGS. 1 and 2 is the flat toner particle having an equivalent circle diameter which is longer than the thickness L, and contains the scary metallic pigment MP.

As illustrated in FIG. 2, when the toner particle T has the flat shape having the equivalent circle diameter which is longer than the thickness L, it is considered that the flat toner particles are arranged on the recording medium to which the toner is finally transferred such that the flat surface side faces the surface of the recording medium. In addition, in the fixing step of the image formation, it is considered that the flat toner particles are arranged by the pressure at the time of fixation such that the flat surface side thereof faces the surface of the recording medium.

As described above, when a cross section of the toner particle in a thickness direction is observed, it is preferable that the number of pigment particles that are present so that an angle between a long axis direction of the toner particle in the cross section and a long axis direction of the pigment particles is from −30° to +30° is equal to or greater than 70% by number of the total pigment particles that are observed. Moreover, the number of metallic pigments is further preferably in a range of 75% by number to 95% by number, and is particularly preferably in a range of 80% by number to 90% by number.

When the number of pigment particles is equal to or greater than 70% by number, it is possible to obtain an image having brilliance which is excellent in uniformity of gloss.

Here, a method of observing cross sections of the toner particles will be described.

The toner particles are embedded using a bisphenol A-type liquid epoxy resin and a curing agent, and a sample for cutting is then prepared. Next, the sample for cutting is cut at −100° C. by using a cutting machine (in this exemplary embodiment, by using a LEICA ultra microtome (manufactured by Hitachi High-Technologies Corporation)) using a diamond knife to prepare a sample for observation. The sample for observation is observed with a transmission electron microscope (TEM) at a magnification of about 5,000 times to observe cross sections of the toner particles. As for the observed 100 toner particles, the number of pigment particles that are present so that the angle between the long axis direction of the toner particles in the cross section and the long axis direction of the pigment particles is from −30° to +30° is counted using image analysis software, and the proportion thereof is calculated.

Note that, the phrase "long axis direction of the toner particles in the cross section" indicates a direction perpendicular to the thickness direction of the toner particle having the average equivalent circle diameter D larger than the average maximum thickness C. In addition, the "long axis direction of the pigment particles" indicates a length direction of the pigment particles.

As for the brilliant toner used in the exemplary embodiment, when a solid image of the toner is formed, a ratio (A/B) of a reflectance A at a light-receiving angle of +30° to a reflectance B at a light-receiving angle of −30°, which are measured when the image is irradiated with incident light at an incident angle of −45° by a goniophotometer with respect to the image, is preferably from 2 to 100.

The phenomenon that the ratio (A/B) is equal to or greater than 2 indicates that reflection on the side (plus-angle side) opposite to the side (minus-angle side) on which the incident light is radiated is larger than reflection on the side on which the incident light is radiated, that is, diffuse reflection of the incident light is prevented. When the diffuse reflection in which the incident light is reflected in various directions occurs and the reflected light is visually confirmed, colors appear to be dull. Therefore, in a case where the ratio (A/B) is equal to or greater than 2, when the reflected light is visually confirmed, the gloss is confirmed and the brilliance becomes more excellent. Further, in a case where the ratio (A/B) is equal to or less than 100, an angle of view at which the reflected light is visually confirmed is not too narrow and thus the phenomenon that an image is viewed as a dark image depending on the angle of view is prevented.

The ratio (A/B) is preferably in a range of 20 to 50, and is further preferably in a range of 40 to 80.

Measurement of Ratio (A/B) by Goniophotometer

First, the incident angle and the light-receiving angle will be described. In this exemplary embodiment, the incident angle is set to −45° in the measurement by a goniophotometer. This is because high measurement sensitivity is achieved for images having a wide range of glossiness.

In addition, the reason why the light-receiving angle is set to −30° to +30° is that the highest measurement sensitivity is achieved in the evaluation of brilliant images and non-brilliant images.

Next, a method of measuring the ratio (A/B) will be described.

In this exemplary embodiment, in the measurement of the ratio (A/B), first, a "solid image" is formed by the following method. The "solid image" refers to an image having a 100% printing rate.

The incident light at an incident angle of −45° to the solid image is radiated on an image portion of the formed solid image by using a spectral varied angle color-difference meter GC5000L as a goniophotometer manufactured by Hippon Denshoku Industries Co., Ltd., and a reflectance A at a light-receiving angle of +30° and a reflectance B at a light-receiving angle of −30° are measured. Each of the reflectance A and the reflectance B is measured for light having a wavelength in a range of 400 nm to 700 nm at intervals of 20 nm, and defined as an average of the reflectances at respective wavelengths. The ratio (A/B) is calculated from these measurement results.

Brilliant Pigment

The above-described brilliant toner preferably contains the brilliant pigment in the toner particle.

As the brilliant pigment, a metallic pigment is preferably exemplified.

Examples of the metallic pigment include metal powder such as aluminum powder, brass powder, bronze powder, nickel powder, stainless steel powder, zinc powder, copper powder, silver powder, gold powder, and platinum powder, and metal deposited flaky glass powder. Among these metallic pigments, the aluminum powder is particularly preferably used from the viewpoint of availability and ease of obtaining a flat shape. The surface of the metallic pigment may be coated with silica particles, an acrylic resin, a polyester resin, or the like. The shape of the metallic pigment is preferably a scaly (plate-shaped) or flat shape, and is further preferably the scaly. In addition, regarding the metallic pigment, the average equivalent circle diameter of the metallic pigment is preferably longer than the average maximum thickness of the metallic pigment.

The metallic pigment may be used singly or in combination of two or more types thereof.

The content of the brilliant pigment in the brilliant toner is preferably in a range of 1 part by weight to 70 parts by weight, and is further preferably in a range of 5 parts by weight to 50 parts by weight with respect to 100 parts by weight of the entire weight of the toner particles.

It is preferable that the metallic pigment used in the exemplary embodiment is subjected to the surface treatment, and it is further preferable that the metallic pigment has a coating layer, and it is still further preferable that the metallic pigment includes a first coating layer containing at least one type of metal oxide selected from the group consisting of silica, alumina, and titania, with which the surface is coated and a second coating layer containing a resin which covers the surface of the first coating layer.

A method of surface treatment of the metallic pigment is not particularly limited, and a well-known surface treatment method may be used; however, a method of forming the first and second coating layers by using the methods described below is preferably exemplified.

The first coating layer contains at least one type of metal oxide selected from the group consisting of silica, alumina, and titania, and these may be used singly or in combination of two or more types thereof.

Among these, the silica is preferably used from the viewpoint of excellent chemical resistance in preparing the toner particles, and the viewpoint that the coating is more uniformly performed on the pigment surface.

Note that, the first coating layer may be formed of only the above-described metal oxides, and may contain impurities entering when the toner particles are prepared.

In the metallic pigment, the element ratio (mol ratio) Mb/Ma of metal Ma in the metallic pigment to metal Mb in the first coating layer is preferably in a range of 0.08 to 0.20. When the element ratio Mb/Ma is equal to or less than 0.20, the reflectance of the light due to the first coating layer is not deteriorated, and thus it is possible to form an image having excellent brilliance. In addition, in a case where the element ratio Mb/Ma is equal to or greater than 0.08, the coating on the surface of the metallic pigment is uniformly performed, and thus the transfer properties are improved under conditions of high temperature and high humidity.

The amount of elements at the time of obtaining the element ratio Mb/Ma is measured by using a fluorescent X-ray analysis (XRF) device.

Specifically, the amount of the metal element in metallic pigment and the first coating layer may be measured in such a manner that a disk having a diameter of 5 cm is prepared by applying a compression pressure of 10 ton to 5 g of the toner particles by using a pressure molding machine, and is set as a measurement sample. Using a x-ray fluorescence spectrometer (XRF-1500) manufactured by Shimadzu Corporation, the disk is subjected to the measurement under measurement conditions of a tube voltage of 40 KV, a tube current of 90 mA, and a measurement time of 30 minutes.

Examples of the coating method by metal oxide include a method of forming a coating layer of metal oxide on the surface of the metallic pigment by using a sol-gel method, and a method of forming a coating layer of metal oxide by precipitating the metal hydroxide on the surface of the metal pigment, and crystallizing the metal hydroxide at a low temperature.

In the exemplary embodiment, it is preferable that an organic metal compound is added such that the element ratio Mb/Ma is in a range of 0.08 to 0.20, a hydrolysis catalyst is added into a dispersion containing the metallic pigment so as to adjust a pH of the dispersion, and then the obtained metal oxide is precipitated on the surface of the metallic pigment.

The coverage amount of the first coating layer is preferably in a range of 10% by weight to 40% by weight, and is further preferably in a range of 20% by weight to 30% by weight with respect to the weight of the metallic pigment.

In addition, the coverage amount of the first coating layer is measured by a calibration curve obtained by measuring the mixture of the aluminum pigment and the silica particle in advance by using the fluorescent X-ray analysis (XRF) device.

The metallic pigment preferably includes the first coating layer and the second coating layer.

The second coating layer is preferably a coating layer formed of a resin.

Examples of the resin used for the second coating layer include an acrylic resin and a polyester resin, which are well-known resins as a binder resin of the toner particle as described below.

Among them, the acrylic resin is preferably used from the viewpoint that the coating is more uniformly performed on the pigment surface.

In addition, a layer formed of the resin which is cross-linked with the second coating layer is preferably used from the viewpoint of excellent chemical resistance and impact resistance at the time of preparing the toner particles.

Note that, the second coating layer may be formed of only the above-described resins, and may contain impurities entering when the toner particles are prepared.

The coverage amount of the second coating layer is preferably in a range of 5% by weight to 30% by weight, is further preferably in a range of 10% by weight to 25% by weight, and is still further preferably in a range of 15% by weight to 20% by weight with respect to the weight of the metallic pigment. When the coverage amount of the second coating layer is equal to or greater than 5% by weight, the coverage of the coating pigment due to the binder resin is secured, and thus the transfer properties are prevented from being deteriorated under conditions of high temperature and high humidity. In addition, when the coverage amount of the second coating layer is equal to or less than 30% by weight, due to the resin forming the second locating layer, the specular reflectance is prevented from being decreased, thereby forming an image having excellent brilliance.

In addition, the coverage amount of the second coating layer is measured by a weight reduction rate when a temperature is increased from 30° C. to 600° C. at an increasing rate of 30° C./min under the nitrogen stream by using a calorimeter measuring device (TGA).

Note that, in order to measure the coverage amount of the second coating layer in the coating pigment in the toner particle, the method described above may be used after components such as the binder resin (a release agent and other components) are removed from the toner particles by using a method of dissolving or sintering.

In addition, the release agent and other components are mixed in the binder resin in the toner particle, and thus the coverage amount of the second coating layer may be measured by separating an area in which the release agent and other components are mixed from the second coating layer in the coating pigment.

The second coating layer is formed as follows.

That is, the second coating layer is formed in such a manner that the coating pigment forming the first coating layer is subjected to a solid-liquid separation, then the resultant is dispersed in a solvent after being washed if necessary, a polymerizable monomer and a polymerization initiator are added to the resultant under the stirring, and after that, a heat treatment is performed so as to precipitate a resin on the surface of the metallic pigment.

Binder Resin

The above-described brilliant toner preferably contains the binder resin in the toner particle.

Examples of the binder resin include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitrides (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, a polyester resin, a polyurethane resin, a polyamide resin, a cellulose resin, a polyether resin, and a modified rosin, a mixture thereof with the above-described vinyl resins, or a graft polymer obtained by polymerizing a vinyl monomer with the coexistence of such non-vinyl resins.

These binder resins may be used singly or in combination of two or more kinds thereof.

A polyester resin is preferably used as the binder resin.

Examples of the polyester resin include well-known polyester resin.

Examples of the polyester resin include condensation polymers of polyvalent carboxylic acids and polyols. A commercially available product or a synthesized product may be used as the polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride, thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid employing a crosslinked structure or a branched structure may foe used in combination together with dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more types thereof.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexandiol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

The glass transition temperature (Tg) of the polyester resin is preferably from 50° C. to 80° C., and more preferably from 50° C. to 65° C.

The glass transition temperature is obtained from a DSC curve obtained by differential scanning calorimetry (DSC).

More specifically, the glass transition temperature is obtained from "extrapolated glass transition onset temperature" described in the method of obtaining a glass transition temperature in JIS K 7121-1987 "testing methods for transition temperatures of plastics".

The weight-average molecular weight (Mw) of the polyester resin is preferably in a range of 5,000 to 1,000,000, and is further preferably in a range of 7,000 to 500,000.

The number-average molecular weight (Mn) of the polyester resin is preferably in a range of 2,000 to 100,000.

The molecular weight distribution Mw/Mn of the polyester resin is preferably in a range of 1.5 to 100, and is further preferably in a range of 2 to 60.

The weight-average molecular weight and the number-average molecular weight are measured by gel permeation chromatography (GPC). The molecular weight measurement by GPC is performed using GPC·HLC-8120 GPC, manufactured by Tosoh Corporation as a measuring device, Column TSK gel Super HM-M (15 cm), manufactured by Tosoh Corporation, and a THF solvent. The weight-average molecular weight and the number-average molecular weight are calculated using a molecular weight calibration curve plotted from a monodisperse polystyrene standard sample from the results of the foregoing measurement.

A known preparing method is used to prepare the polyester resin. Specific examples thereof include a method of conducting a reaction at a polymerization temperature set to be in a range of 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is preferably in a range of 40% by weight to 95% by weight, is further preferably in a range of 50% by weight to 90% by weight, and is still further preferably in a range of 60% by weight to 85% by weight, with respect to the entire toner particles.

Release Agent

The above-described brilliant toner preferably contains the release agent in the toner particle.

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

As examples of the release agent, ester wax, polyethylene, polypropylene, and a copolymer of polypropylene or polyethylene are preferably used; however, specific examples thereof include polyglycerol wax, microcrystalline wax, paraffin wax, carnauba wax, Sasol wax, montan acid ester wax, deoxidized carnauba wax, unsaturated fatty acids such as palmitic acid, stearic acid, montanic acid, prandin acid, eleostearic acid, and parinaric acid, saturated alcohol such as stearyl alcohol, aralkyl alcohol, bephenyl alcohol, carnaubyl alcohol, glyceryl alcohol, melissyl alcohol or long-chain alkyl alcohols having a further long chain alkyl group; polyols such as sorbitol; fatty amides such as linoleic acid amide, oleic acid amide, and lauric acid amide; saturated fatty acid bisamide such as methylene-bis-stearic acid amide, ethylene-bis-capric acid amide, ethylene-bis-lauric acid amide, hexamathylene-bis-stearic acid amide; unsaturated fatty acid amides such as ethylene-bis-oleic acid amide, hexamethylene-bis-oleic acid amide, N,N'-dioleyl adipic acid amide, and N,N'-dioleylsebacic acid amide; aromatic bisamide such as m-xylene bis stearic acid amide, and N,N'-distearyl isophthalic acid amide; fatty acid metal salts such as calcium stearate, calcium laurate, zinc stearate, and magnesium stearate (which generally are called metal soap); waxes obtained by grafting aliphatic hydrocarbon waxes by using vinyl monomers such as styrene or acrylic acid; a partial ester compound of fatty acid such as behenic acid monoglyceride and polyols; and a methyl ester compound having a hydroxyl group obtained by hydrogenating vegetable oil.

The release agent may be used singly or in combination of two or more types thereof.

The content of the release agent is preferably in a range of 1 part by weight to 20 parts by weight, and is further preferably in a range of 3 by weight to 15 parts by weight with respect to 100 parts by weight of the binder resin. When the content thereof is within the above range, it is possible to achieve both excellent fixing properties and image quality.

Surfactant

The above-described brilliant toner preferably contains the surfactant in the toner particle.

Examples of the surfactant include an anionic surfactant, a cationic surfactant, and a nonionic surfactant. A compound which is in a solid state at 25° C. is preferably used, the anionic surfactant or the cationic surfactant is preferably used, and the anionic surfactant is farther preferably used. With such a configuration, it is likely that the obtained image has less color unevenness.

As specific examples of the anionic surfactant, the cationic surfactant, and the nonionic surfactant, those which are described in the coating layer of the carrier are preferably used.

In addition, as described above, as for the electrostatic charge image developer according to the exemplary embodiment, it is preferable that both of the surfactant contained in the brilliant toner and the surfactant contained in the coating layer are anionic surfactants, and it is particularly preferable that both of the surfactant contained in the brilliant toner and the surfactant contained in the coating layer are surfactants having the same properties. With such a configuration, the color unevenness of the obtained shape is less likely to occur.

The surfactant may be used singly or in combination of two or more types thereof.

The content of the surfactant is preferably in a range of 0.01% by weight to 10% by weight, is further preferably in a range of 0.1% by weight to 5% by weight, and is still further preferably in a range of 0.5% by weight to 3% by weight with respect to the entire weight of the toner particles.

Other Colorants

The above-described brilliant toner may contain colorants, if necessary, in addition to the brilliant pigment.

As other colorants, well-known matters may be used, which may be optionally selected in terms of hue angle, saturation brightness, weather resistance, OHP transparency, and dispersibility in the toner.

Specific example of the colorant include various types of pigments such as Watchung Red, Permanent Red, Brilliant Carmine 3B, Brilliant Carmine 6B, Du Pont Oil Red, pyrazolone Red, lithol Red, Rhodamine 8 lake, and Lake Red C and various types of colorant such as acridine, xanthene, azo, benzoquinone, azine, anthraquinone, thioindigo, dioxazine, thiamine, azomethine, indigo, thioindigo, phthalocyanine, aniline black, polymethine, triphenylmethane, diphenylmethane, thiazine, thiazole, and xanthene.

In addition, as the specific examples of other colorants, carbon black, nigrosine dye (C.I. No. 50415B), Aniline blue (C.I. No. 50405), Calco Oil Blue (C.I. azoic Blue3), Chrome yellow (C.I. No. 14090), Ultramarine Blue (C.I. No. 77103), Du Pont Oil Red (C.I. No. 26105), Quinoline yellow (C.I. No. 47005), Methylene blue chloride (C.I. No. 52015), Phthalocyanine blue (C.I. No. 74160), Malachite Green Oxalate (C.I. No. 42000), Lamp black (C.I. No. 77286), Rose Bengal (C.I. No. 45435), and the mixture thereof are preferably used.

The use amount of other colorants is preferably in a range of 0.1 parts by weight to 20 parts by weight, and is further preferably in a range of 0.5 parts by weight to 1.0 parts by weight with respect to 100 parts by weight of toner particles. In addition, as the colorant, these pigments and dyes may be used singly or in combination of two or more types thereof.

As a method of dispersing other colorants, an optional method, for example, a general dispersing method performed by using a rotary shearing-type homogenizer, or a ball mill, a sand mill, and a dyno mill which have media may be used. The method thereof is not limited. In addition, these colorant particles may be added at once with other particle components in a mixed solvent, or may be divided and added in multiple stages.

External Additive

The above-described brilliant toner may contain an external additive.

Examples of the external additive include inorganic particles and organic particles, and the inorganic particles are preferably used.

Examples of the inorganic particles include silica, alumina, titanium oxide, metatitanic acid, barium titanate, magnesium titanate, calcium titanate, strontium titanate, zinc oxide, silica sand, olay, mica, wollastonite, diatomaceous earth, cerium chloride, red iron oxide, chromium oxide, cerium oxide, antimony trioxide, magnesium oxide, zirconium oxide, silicon carbide, and silicon nitride.

Among them, the titanium compound particles are preferably used, titanium oxide and/or metatitanic acid particles are/is further preferably used, and the metatitanic acid particles are particularly preferably used.

The surfaces of inorganic particles are preferably subjected to a hydrophobic treatment in advance.

The hydrophobic treatment may be performed by dipping the inorganic particles into a hydrophobizing agent. The hydrophobizing agent is not particularly limited; for example, examples thereof include a silane coupling agent, a silicone oil, a titanate coupling agent, and an aluminum coupling agent. These may be used singly or in combination of two or more types thereof. Among them, the silane coupling agent is preferably used.

The organic particles are generally used to improve the cleaning property and the transferring property, and specific examples thereof include fluorine resin powder such as polyvinylidene fluoride and polytetrafluoroethylene, polystyrene, and polymethylmethacrylate.

The number average primary particle diameter of the external additive is preferably in a range of 1 nm to 300 nm, is further preferably in a range of 10 nm to 200 nm, and is still further preferably in a range of 15 nm to 180 nm.

In addition, the external additive may be used singly or in combination of two or more types thereof.

The ratio of external additive in the brilliant toner is preferably in a range of 0.01 parts by weight to 5 parts by weight, and is further preferably in a range of 0.1 parts by weight to 3.5 parts by weight with respect to 100 parts by weight of the toner particles.

Other Components

In addition to the above-described components, various types of components may be added to the brilliant toner, if necessary, such as an internal additive, a charge control agent, inorganic powders (inorganic particles), and organic particles.

Examples of the internal additive include metal such as ferrite, magnetite, reduced iron, cobalt, nickel, and manganese, alloys, or magnetic materials such as compounds containing these metals. In case of using a magnetic toner containing the magnetic materials, the magnetic materials have the average particle diameter which is preferably equal to or less than 2 μm, and is further preferably in a range of 0.1 μm to 0.5 μm. The content of the magnetic materials in the toner is preferably in a range of 20 parts by weight to 200 parts by weight with respect to 100 parts by weight of resin component, and is particularly preferably in a range of 40 parts by weight to 150 parts by weight with respect to 100 parts by weight of resin component. In addition, the magnetic materials preferably have the magnetic properties by application of 10K Oersted of a coercive force (Hc) of 20 Oersted to 300 Oersted, a saturated magnetization ($\sigma s$) of 50 emu/g to 200 emu/g, and a residual magnetization ($\sigma r$) or 2 emu/g to 20 emu/g.

Examples of a charge-controlling agent include: a metal-containing dye such as a fluorine surfactant, a salicylic acid metal complex, and an azo metal compound, poly acid such as a polymer containing maleic acid as a monomer component, and azine dyes such as quaternary ammonium salt and nigrosine.

The brilliant toner may contain inorganic powders for the purpose of viscoelastic adjustment. Examples of the inorganic powders include the inorganic particles used as the external additive of the typical toner surface such as silica, alumina, titania, calcium carbonate, magnesium carbonate, phosphate calcium, and cerium oxide which will be described in detail.

Formation and Physical Properties of Toner

The volume average particle diameter of the toner is preferably in a range of 1 μm to 30 μm, and is further preferably in a range of 10 μm to 20 μm. Note that, in a case where the toner has a flat shape as that of the brilliant toner in the exemplary embodiment, the value of the volume average particle diameter indicates a volume average value of the sphere equivalent diameter.

Specifically, regarding the volume average particle diameter $D_{50v}$, cumulative distributions by volume and by number are drawn from the side of the smallest diameter with respect to particle diameter ranges (channels) separated based on the particle diameter distribution measured by using the Coulter Multisizer II (manufactured by Beckman Coulter, Inc.). The particle diameter when the cumulative percentage becomes 16% is defined as that corresponding to a volume average particle diameter $D_{16v}$ and a number average particle diameter $D_{16p}$, while the particle diameter when the cumulative percentage becomes 50% is defined as that corresponding to a volume average particle diameter and a number average particle diameter $D_{50p}$. Furthermore, the particle diameter when the cumulative percentage becomes 84% is defined as that corresponding to a volume average particle diameter $D_{84v}$ and a number average particle diameter $D_{84p}$. Using these, a volume average particle diameter distribution index (GSDv) is calculated as $(D_{84v}/D_{16v})^{1/2}$.

The average particle diameter of the toner particles is measured using a Coulter Multisizer II (manufactured by Beckman Coulter, Inc.). In this case, the measurement may be performed by using an optimal aperture in accordance with the particle diameter level of the particles. The measured particle diameter of particles indicates the volume average particle diameter.

In a case where the particle diameter of particles is approximately equal to or less than 5 μm, the measurement may foe performed by using a laser diffraction type particle size distribution measuring device (for example, LA-700 manufactured by Horiba, Ltd.).

Further, in a case where the particle diameter is the nano-meter size, the measurement may be performed by using a BET specific surface area measuring apparatus (FLOWSORB II 2300, manufactured by Shimadzu Corporation).

Method of Preparing Brilliant Toner

The brilliant toner according to this exemplary embodiment may be prepared through known methods such as wetting methods or drying methods, but is preferably prepared through the use of the wetting methods. Examples of the wetting methods include a melt and suspension method, an emulsion aggregating method, and a dissolution and suspension method. Among these methods, the emulsion aggregating method is particularly preferably used from the view point that it is easy to control the shape of the toner particle and the particle diameter, and a control range of a toner particle structure such as a core/shell structure is wide.

Here, the emulsion aggregating method includes a method of preparing dispersions (an emulsion, a metallic pigment dispersion, and the like) including components (a binder resin, a colorant, and the like) contained in the toner, blending these dispersions to form a mixed solution, and heating the aggregated particles to the melting temperature or equal to or higher than the glass transition temperature of the binder resin (equal to or higher than the melting temperature of a crystalline resin and equal to or higher than the glass transition temperature of an amorphous resin when preparing the toner including both the crystalline resin and the amorphous resin) to aggregate and coalesce the toner components.

The toner may be preferably prepared through the following preparation method when the toner is prepared through the emulsion aggregating method.

Emulsification Step

The resin particle dispersion is prepared by using a general polymerization method such as an emulsion polymerization method, a suspension polymerization method, and a dispersion polymerization method. In addition to the above method, the resin particle dispersion may be prepared by being subjected to emulsification by imparting a shear force to a solution obtained by mixing an aqueous medium with a binder resin by using a dispersing machine. At that time, the particles may be formed by being heated so as to decrease the viscosity of the resin components. Further, the dispersant may be used for stability of the dispersed resin particles. Moreover, in a case where the resin is oily and thus is dissolved in a solvent having the relatively low solubility with respect to water, the resin particle dispersion is prepared in such a manner that the resin is dissolved in the solvent such that the particles are dispersed in water together with the dispersant and polyelectrolyte, and thereafter, the heated or compressed solvent is evaporated.

Examples of the aqueous medium include water such as distilled water and deionized water, and alcohols, and water is preferably used.

In addition, examples of the dispersant which is used in the emulsification step include a water-soluble polymer such as polyvinyl alcohol, methyl cellulose, ethyl cellulose, hydroxyethyl cellulose, carboxymethyl cellulose, sodium polyacrylate, and sodium polymethacrylate; surfactants such as an anionic surfactant such as sodium dodeoyl benzene sulfonate, sodium octadecyl sulfate, sodium oleate, sodium lauryl acid, and potassium stearate, a cationic surfactant such as lauryl amine acetate, stearyl amine acetate, and lauryl trimethyl ammonium chloride, an ampholytic surfactant such as lauryl dimethyl amine oxide, a nonionic surfactant such as polyoxyethylene alkyl ether, polyoxyethylene alkyl phenylene ether, and polyoxyethylene alkylamine; mineral salt such as tricalcium phosphate, aluminum hydroxide, calcium sulfate, calcium carbonate, and barium carbonate.

Examples of the dispersing machine which is used to prepare the emulsion include a homogenizer, a homomixer, a pressure kneader, an extruder, and a media dispersing machine. As the size of the resin particles, the average particle diameter (volume average particle diameter) is preferably equal to or less than 1.0 μm, is further preferably in a range of 60 nm to 300 nm, and is still further preferably in a range of 150 nm to 250 nm. If the average particle diameter is equal to or greater than 60 nm, the resin particles become stable in the dispersion, and it is easy to prevent the resin particles from being aggregated in some cases. Further, If the average particle diameter is equal to or less than 1.0 μm, the particle diameter distribution of the toner becomes smaller in some cases.

Pertaining to preparing the release agent dispersion, a release agent is dispersed into water together with polyelectrolytes such as an ionic surfactant or a polymeric acid or polymeric base, then heated to a temperature equal to or higher than the melting temperature of the release agent, and then the resultant is subjected to the dispersing treatment by using a homogenizer or a pressure discharge type dispersing machine to which a high shearing force is applied. Through this treatment, the release agent dispersion is obtained. In the dispersing treatment, an inorganic compound such as polyaluminum chloride may be added to the dispersion. Examples of the inorganic compound which is preferably used include polyaluminum chloride, aluminum sulfate, high basic polyaluminum chloride (BKC), polyaluminum hydroxide, and aluminum chloride. Among them, the polyaluminum chloride and the aluminum sulfate are preferably used.

Through the dispersing treatment, the release agent dispersion containing the release agent particles having the volume average particle diameter of equal to or less than 1 μm is obtained. Note that, the volume average particle diameter of the release agent particles is preferably in a range of 100 nm to 500 nm. In a case where the volume average particle diameter is equal to or greater than 100 nm, the properties of the binder resin to be used is affected, for example, generally, the release agent components are easily taken into the toner. In addition, in a case where the volume average particle diameter is equal to or less than 500 nm, the release agent is satisfactorily dispersed in the toner.

Examples of the method of preparing the metallic pigment dispersion includes well-known dispersing methods by using a general dispersing unit such as a rotating shear type homogenizer, a ball mill including media, a sand mill, a dyno mill, and an ultimizer, and the method thereof is not particularly limited. The metallic pigment is dispersed into water together with polyelectrolytes such as an ionic surfactant or a polymeric, acid or polymeric base. The volume average particle diameter of the dispersed metallic pigment may be equal to or less than 20 μm, and when the volume average particle diameter thereof is preferably in a range of 3 μm to 16 μm, the metallic pigment is satisfactorily dispersed in the toner without damaging to the aggregation.

In addition, the dispersion of the metallic pigment which is coated with the binder resin may be prepared in such a manner that the metallic pigment and the binder resin are dispersed and/or dissolved in the solvent so as to be mixed with each other, and the mixture is dispersed in water through phase-transfer emulsification or shearing emulsification.

Aggregating Step

In the aggregating step, the dispersion of the resin particles, the metallic pigment dispersion, and the release agent dispersion are mixed, the mixed solution is heated at a temperature which is equal to or lower than the glass-transition temperature of the resin particles, and then aggregated, thereby forming aggregated particles. The aggregated particles are formed by adjusting a pH of the mixed solution to be acidic under the stirring in many cases. The ratio (C/D) is likely to be in a preferable range by the above-described stirring conditions. More specifically, the ratio (C/D) becomes smaller when the stirring is performed at a high speed while the heating is performed in the stage at which the aggregated particles are formed, whereas the ratio (C/D) becomes greater when stirring is performed at a lower speed while the heating is performed at a lower temperature. Note that, the pH is preferably in a range of 2 to 7, and in this case, using an aggregating agent is useful.

In addition, in the aggregating step, the release agent dispersion may be added and mixed together with various types of dispersions such as the resin particle dispersion at once, or may be separately added in plural times.

As the aggregating agent, a surfactant having a polarity to that of surfactant used as the dispersant, an inorganic metal salt, and a metal complex having a valency of 2 or higher are preferably used. Particularly, in a case where the metal complex is preferably used, the use amount of the surfactant is reduced, and thus the charging properties are improved.

As the inorganic metal salt, aluminum salts and polymers thereof are particularly preferably used. In order to obtain the smaller particle diameter distribution, the valence of the inorganic metal salt is preferably divalent rather than monovalent, is further preferably trivalent rather than divalent, and is still further preferably tetravalent rather than trivalent. In addition, if the valences are the same, the polymerization-type inorganic metal salt polymer is preferably used.

In the exemplary embodiment, a polymer of tetravalent inorganic metal salt containing aluminum is preferably used in order to obtain small particle diameter distribution.

In addition, the toner may be prepared in such a manner that surfaces of core aggregated particles are coated with the resin by adding the resin particle dispersion when the aggregated particles have a desired particle diameter (coating step). In this case, the release agent and the metallic pigment are less likely to be exposed to the toner surface, and thus the above-described configuration is preferable in terms of the charging properties and the developing properties. In a case of adding the resin particle dispersion, the aggregating agent may be added or the pH is adjusted before adding the resin particle dispersion.

Coalesce Step

In the coalesce step, the particles are prevented from being aggregated by increasing the pH of the suspension of the aggregated particles in a range of 3 to 9 under the stirring based on the aggregating step, and the heating at a temperature which is equal to or higher than the glass-transition temperature of the resin is performed so as to cause the aggregated particles to coalesce.

In addition, in a case where the aggregated particles are coated with the resins, the core aggregated particles are coated with the resins which coalesce with each other. The heating may be performed such that the resins coalesce with each other, and the heating time is preferably in a range of 0.5 hours to 10 hours.

After performing the coalescing, the aggregated particles are cooled, and thereby coalescing particles are obtained. In addition, in the cooling step, the cooling speed may be decreased in the vicinity of the glass-transition temperature (glass-transition temperature in a range of ±10° C.) of the resin, that is, the cooling may be slowly performed so as to facilitate the crystallization.

The coalescing particles through the coalescing step go through a solid-liquid separation step such as filtration, a washing step, and a drying step, if necessary, thereby forming the toner particles.

The toner according to the exemplary embodiment is manufactured by, for example, adding an external additive to the obtained dry toner particles and mixing them. The mixing may be preferably performed with a V-blender, a Henschel mixer, or a Roedige mixer. Furthermore, if necessary, coarse toner particles may be removed using a vibrating sieve, a wind classifier, or the like.

A method of attaching the external additive on the surface of the toner particle is not particularly limited, and well-known methods are used, for example, a method of attaching the external additive by using a mechanical method or a chemical method.

Image Forming Method

The image forming method which is used in electrostatic charge image developer according to the exemplary embodiment will be described. The electrostatic charge image developer according to the exemplary embodiment is used in the image forming method which employs a well-known electrophotographic method. Specifically, the electrostatic charge image developer is used in the image forming method including the following steps.

That is, the preferable image forming method includes a step of forming an electrostatic latent image on a surface of an image holding member, a step of developing the electrostatic latent image formed on the surface of the image holding member by using a developer containing the toner so as to form a toner image, a step of transferring the toner image formed on the surface of the image holding member onto a transfer medium, and a step of fixing the toner image transferred onto the transfer medium, in which the electrostatic charge image developer according to the exemplary embodiment is used as the developer. In addition, in the transfer step, when an intermediate transfer member which mediates the toner image transferred from the image holding member to the transfer medium is used, the effects of the exemplary embodiment are likely to be exhibited.

In addition, the image forming method further includes a step of cleaning the toner remaining on the surface of the image holding member after transferring the toner image.

The respective steps are typical steps. Note that, the image forming method according to the exemplary embodiment may be performed by using a known image forming apparatus such as a copying machine and a facsimile machine.

The electrostatic latent image forming step is a step of forming the electrostatic latent image on the surface of the image holding member (a photoreceptor).

The developing step is a step of developing the electrostatic latent image on a developer holding member by using the electrostatic charge image developer so as to form a toner image.

The transfer step is a step of transferring the toner image on the transfer medium. In addition, examples of the transfer medium in the transfer step include an intermediate transfer member or a recording medium such as a sheet.

In the fixing step, a method of fixing the toner image transferred onto a transfer sheet by using a heat-roller fixing device in which the temperature of the heat roller is set to be a certain temperature so as to form a copy image is exemplified.

The cleaning step is a step of removing the electrostatic charge image developer remaining on the image holding member.

Examples of the transfer medium include an intermediate transfer member or a recording medium such as a sheet.

Examples of the recording medium include plain paper used for an electrophotographic copying machine, a printer, or the like, and an OHP sheet, and, for example, coated paper obtained by coating a surface of plain paper with a resin or the like, or an paper for printing is preferably used.

The image forming method according to the exemplary embodiment further may include a recycle step. The recycle step is a step of transferring recovered electrostatic charge image developing toners from the cleaning step to a developer layer. The image forming method including the recycle step is performed by using an image forming apparatus such as a toner recycling system type of copy machine and a facsimile machine. In addition, the method may be applied to a recycle system in which the toner is concurrently developed and recovered, instead of the cleaning step.

Image Forming Apparatus

The image forming apparatus according to the exemplary embodiment is an image forming apparatus using the electrostatic charge image developer according to the exemplary embodiment. The image forming apparatus according to the exemplary embodiment will be described.

The image forming apparatus according to the exemplary embodiment is provided with an image holding member, a charging unit that charges the image holding member, an exposure unit that forms an electrostatic latent image on the surface of the image holding member by exposing the charged image holding member, a developing unit that develops the electrostatic latent image by using a developer containing the toner so as to form a toner image, a transfer unit that transfers the toner image to a surface of a transfer medium from the image holding member, and a fixing unit that fixes the toner image transferred onto the surface of the transfer medium, in which the developer is preferably the electrostatic charge image developer according to the exemplary embodiment.

Note that, the image forming apparatus according to the exemplary embodiment is not particularly limited as long as it is provided with at least one of the image holding member, the charging unit, the exposing unit, the developing unit, the transfer unit, and the fixing unit, and if necessary, a cleaning unit or a discharging, unit may be further included.

In a case of an intermediate transfer type image forming apparatus, the transfer unit includes, for example, an intermediate transfer member in which a toner image is transferred to the surface thereof, a primary transfer unit that firstly transfers the toner image formed on a surface of an image holding member onto the surface of the intermediate transfer member, and a secondary transfer unit that secondarily transfers the toner image transferred onto the surface of the intermediate transfer member onto a surface of a recording medium.

It is preferable that the image holding member and the respective units employ the configuration described in the respective steps of the image forming method. As examples of the respective units, well-known units in the image forming apparatus are used. In addition, the image forming apparatus according to the exemplary embodiment may include other units and devices in addition to the above-described configuration. Further, in the image forming apparatus according to the exemplary embodiment, plural units among the above-described unites may be performed at the same time.

Examples of the cleaning unit include a cleaning blade and a cleaning brush.

In the image forming apparatus, for example, a part including the developing unit may have a cartridge structure (process cartridge) that is detachable from the image forming apparatus. As the process cartridge, for example, a process cartridge that is provided with at least a developer holding member and contains the electrostatic charge image developer according to the exemplary embodiment is preferably used.

Hereinafter, an example of the image forming apparatus according to the exemplary embodiment will be described. However, the image forming apparatus is not limited thereto. Major parts shown in the drawing will be described, but descriptions of other parts will be omitted.

Figure 3:
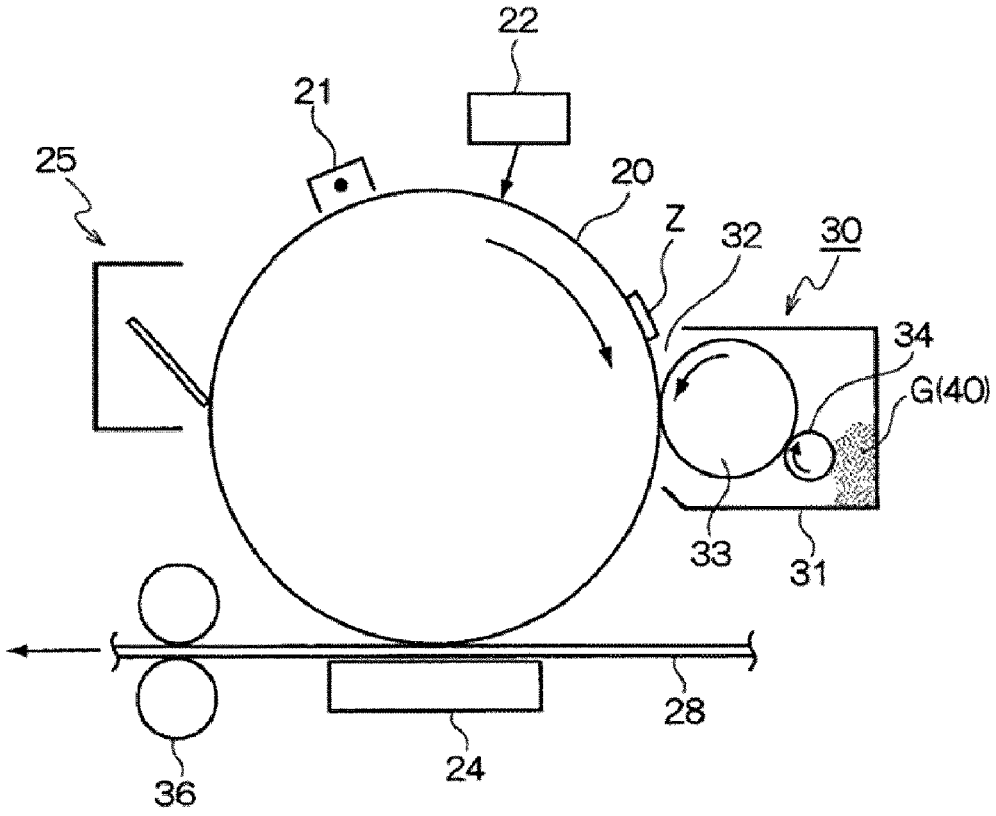
FIG. 3 is a schematic diagram illustrating an example of an image forming apparatus according to the exemplary embodiment which includes a developing device to which an electrostatic charge image developer according to the exemplary embodiment is applied.

FIG. 3 is a schematic diagram illustrating an example of the image forming apparatus according to the exemplary embodiment which includes a developing device to which the electrostatic charge image developer according to the exemplary embodiment is applied.

In FIG. 3, the image forming apparatus according to the exemplary embodiment is provided with a photoreceptor 20 (an example of the image holding member) that rotates in a predetermined direction as an image holding member, and a charging device 21 (an example of the charging unit) that charges the photoreceptor 20, an exposure device 22 (an example of the exposure unit) as an electrostatic charge image forming device that forms an electrostatic charge image 2 on the photoreceptor 20, a developing device 30 (an example of the developing unit) that visualizes the electrostatic charge image 2 formed on the photoreceptor 20, a transfer device 24 (an example of the transfer unit) that transfers the visualized toner image on the photoreceptor 20 to a recording sheet 28 which is a recording medium, and a cleaning device 25 (an example of the cleaning unit) that cleans the toner remaining on the photoreceptor 20 are sequentially disposed around the photoreceptor 20.

In the exemplary embodiment, the developing device 30 includes a developing container 31 in which a developer G containing a toner 40 is contained, as illustrated in FIG. 3, and in the developing container 31, a development opening 32 is provided facing the photoreceptor 20 and a developing roller (a developing electrode) 33 is provided as a toner holding member facing to the development opening 32, and a certain developing bias is applied to the developing roller 33 such that a developing electric field is formed in an area (a developing area) which is nipped between the photoreceptor 20 and the developing roller 33. Further, as a charge injection member, a charge injection roller (an injection electrode) 34 is provided facing the developing roller 33 in the developing container 31. Particularly, in the exemplary embodiment, the charge injection roller 34 also serves as a toner supply roller for supplying the toner 40 to the developing roller 33.

Here, the rotation direction of the charge injection roller 34 may be selectively determined; however, in consideration of the properties of toner supply and charge injection, the charge injection roller 34 is preferably disposed facing the developing roller 33, rotated in the same direction with the peripheral speed difference (for example, 1.5 times or more), and injects the charges while scrapping the toner 40 being nipped in the area nipped between the charge injection roller 34 and the developing roller 33.

Next, an operation of the image forming apparatus according to the exemplary embodiment will be described.

When an image forming process is started, first, the surface of the photoreceptor 20 is charged by the discharging device 21, the electrostatic charge image Z is written onto the photoreceptor 20 to which the exposure device 22 is charged, and the developing device 30 causes the electrostatic charge image Z to be visualized as the toner image. Thereafter, the toner image on the photoreceptor 20 is transferred to a transferred portion, and the transfer device 24 electrostatically transfers the toner image on the photoreceptor 20 to the recording sheet 28 which is the recording medium. Note that, the toner remaining on the photoreceptor 20 is cleaned by a cleaning device 25. After that, the toner image is fixed onto the recording sheet 28 by using a fixing device 36 (an example of the fixing unit), thereby obtaining an image.

Developer Cartridge and Process Cartridge

The developer cartridge according to the exemplary embodiment is a developer cartridge which contains at least the electrostatic charge image developer according to the exemplary embodiment. The developer cartridge according to the exemplary embodiment may have a container which contains the electrostatic charge image developer according to the exemplary embodiment.

In addition, the process cartridge according to the exemplary embodiment is a process cartridge which contains the electrostatic charge image developer according to the exemplary embodiment, and is provided with a developer holding member which holds and transfers the electrostatic charge image developer, in which the process cartridge preferably includes at least one selected from the group consisting of a developing unit for developing the electrostatic latent image on the surface of the image holding member by using the electrostatic charge image developing toner or the electrostatic charge image developer so as to form a toner image, a charging unit for charging the image holding member and the surface of the image holding member, and a cleaning unit for removing the toner remaining on the surface of the image holding member, and the process cartridge preferably contains at least the electrostatic charge image developer according to the exemplary embodiment.

The developer cartridge according to the exemplary embodiment is not particularly limited as long as the developer cartridge contains the electrostatic charge image developer according to the exemplary embodiment. The developer cartridge is detachable from the image forming apparatus which includes the developing unit, and contains the electrostatic charge image developer according to the exemplary embodiment as a developer for being supplied to the developing unit. The developer cartridge according so the exemplary embodiment may have a container which contains the electrostatic charge image developer according to the exemplary embodiment.

Further, the developer cartridge may be a cartridge which contains a toner and a carrier, and may be a cartridge in which a separated body of a cartridge for accommodating a toner alone and a cartridge for accommodating a carrier alone are separately formed.

The process cartridge according to the exemplary embodiment is preferably detachable from the image forming apparatus.

In addition, the process cartridge according to the exemplary embodiment may include other members such as a discharging unit if necessary.

As the process cartridge, a well-known configuration may be employed.

Examples

Hereinafter, the exemplary embodiment will be further specifically described with reference to examples and comparative examples; however, the exemplary embodiment is not limited to the examples.

Note that, in the following description, unless specifically noted, "parts" means "parts by weight" and "%" means "% by weight".

Measuring Method

The ratio (C/D) in the toner, the volume average particle diameter, and the content of the surfactant in the coating layer of the carrier are measured by using the above-described method.

Preparation of Titanium Compound Particles

The titanium compound particles are prepared by using the following method.

Specifically, ilmenite is used as ore, the iron is separated by dissolving the ilmenite in sulfuric acid, the obtained $TiOSO_4$ is hydrolyzed, and washing is performed with water until the pH of the filtrate is constant. 3N of hydrochloric acid is added to the resultant, the pH is adjusted from pH 6.5 to pH 7, the concentrated sulfuric acid is added thereto, the concentration of hydrochloric acid is adjusted to 110 g/L, the concentration of $TiO_2$ is adjusted to 50 g/L, the stirring is performed at 30° C. for 2 hours, and then is kept to stand, thereby preparing $TiO(OH)_2$ slurry. 38 parts by weight of tertiary-butyl trimethoxysilane with respect to the obtained 100 parts (in terms of $TiO(OH)_2$) of $TiO(OH)_2$ is mixed, stirred at 80° C. for 30 minutes, then 7N of aqueous sodium hydroxide is added, is neutralized at pH 6.8, filtrated by using a suction funnel, and washed with water. After that, the resultant is dried at 120° C. for 10 hours, and the soft aggregation is dispersed by using a pin mill, thereby preparing the titanium compound particles 1.

The volume average particle diameter of the obtained titanium compound particles 1 is 30 nm.

Preparation of Toner Particles (1)

Synthesis of Binder Resin

Ethylene oxide 2 mol adduct of bisphenol A: 216 parts
Ethylene glycol: 38 parts
Terephthalic acid: 200 parts
Tetrabutoxy titanate (catalyst): 0.037 parts The above components are put into a two-necked flask which is dried by heating, nitrogen gas is introduced in a container to maintain an inert atmosphere, and the components are heated while stirring, and then are subjected to co-condensation polymerization reaction for 160° C. for 7 hours, and thereafter, the temperature is increased up to 220° C. while the gas is slowly decreased to 10 Torr, and maintained for 8 hours. Once the pressure is returned to be in a normal state, 9 parts of trimellitic anhydride is added to the container, and the pressure is slowly decreased to 10 Torr again and maintained at 220° C. for 2 hours, thereby synthesizing the binder resin. Note that, 1 Torr is approximately 133.3 Pa.

Preparation of Resin Particle Dispersion

Binder resin: 160 parts

Ethyl acetate: 233 parts

Aqueous sodium hydroxide (0.3N): 0.1 parts

The above components are put into a separable flask, heated at 70° C., and stirred by using THREE-ONE MOTOR (manufactured by Shinto Scientific Co., Ltd.) thereby preparing a resin mixed solution. The resin mixed solution is further stirred while slowly adding 373 parts of ion exchange water thereto, and subjected to phase inversion emulsification and desolvation treatment, thereby obtaining the resin particle dispersion (concentration of solid content: 30%).

Preparation of Release Agent Dispersion

Carnauba wax (manufactured by Toa Kasei Co., Ltd., RC-160): 50 parts

Anionic surfactant (manufactured by Dai-Ichi Kogyo Seiyaku Co., Ltd., NEOGEN RK): 1.0 parts Ion exchange water: 200 parts The above components are mixed, heated at 95° C., dispersed by using a homogenizer (manufactured by IKA Ltd., ULTRA-TURRAX T50), then subjected to a dispersion treatment by using MANTON-GAULIN HIGH PRESSURE HOMOGENIZER (manufactured by SPX Flow, Inc.) for 360 minutes, and thereby a release agent dispersion (concentration of solid content: 20%) which is obtained by dispersing the release agent particles having the volume average particle diameter of 0.23 μm.

Preparation of Brilliant Pigment Particle Dispersion

Aluminum pigment (manufactured by TOYO ALUMINUM K.K., 2173EA): 100 parts

Anionic surfactant (manufactured by Dai-ichi Kogyo Seiyaku Co., Ltd., Neogen R): 1.5 parts Ion exchange water: 900 parts The above components are mixed after removing a solvent from paste of the aluminum pigment, the mixture is dispersed for one hour by using an emulsification dispersing machine CAVITRON (manufactured by Pacific Machinery & Engineering Co., Ltd, CR1010), thereby preparing brilliant pigment particle dispersion (concentration of solid content: 10%) obtained by dispersing the brilliant pigment particles (aluminum pigment).

Preparation of Toner Particles

Preparation of Toner Particles (1)

Resin particle dispersion: 450 parts

Release agent dispersion: 50 parts

Brilliant pigment particle dispersion: 21.74 parts

Nonionic surfactant (manufactured by Rhodia, IGEPAL CA897): 1.40 parts

The above raw materials are put into cylindrical stainless container, dispersed and mixed for 10 minutes while applying a shear force at 4,000 rpm using a homogenizer (ULTRA-TURRAX T50 manufactured by IKA Ltd.). Then, 1.75 parts of 10% nitric acid aqueous solution of polyaluminum chloride are slowly added dropwise as an aggregating agent, and the resultant material is dispersed and mixed for 15 minutes by setting a rotating speed of the homogenizer to 5,000 rpm, and is set to a raw material dispersion.

After that, the raw material dispersion is put into a polymerization tank including a stirring device using stirring blades of two paddles and a thermometer, heating is started with a mantle heater after setting a stirring rotation speed to 810 rpm, and growth of aggregated particles is promoted at 54° C. At that time, pH of the raw material dispersion is controlled to be in a range of 2.2 to 3.5 with 0.3N nitric acid and 1 N sodium hydroxide aqueous solution. The raw material dispersion is maintained in the pH range described above for approximately 2 hours and the aggregated particles are formed. At this time, vine volume average particle diameter of the aggregated particles measured by using Multisizer II (aperture diameter: 50 μm manufactured by Beckman Coulter, Inc.) is 10.4 μm.

Next, 100 parts of resin particle dispersion are added and the resin particles of the binder resin are attached to the surface of the aggregated particles. In addition, the temperature thereof is increased to 56° C., and the aggregated particles are prepared while confirming the size and formation of the particles by using an optical microscope and Multisizer II. After that, after increasing pH to 8.0 for coalescing the aggregated particles, the temperature thereof is increased to 67.5° C. After confirming that the aggregated particles are coalesced with the optical microscope, pH thereof is decreased to 6.0 while maintaining the temperature at 67.5° C., the heating is stopped after 1 hour, and cooling is performed at a temperature falling rate of 1.0° C./min. Then, after performing sieving with a mesh of 2.0 μm and repeating water washing, the resultant material is dried with a vacuum drying machine to obtain toner particles (1).

Preparation of Toner Particles (2)

The toner particles (2) is prepared by using the same method as that in Preparation of toner particles (1) except that the stirring rotation speed in the step of promoting the growth of the aggregated particles is changed from 810 rpm to 600 rpm and the temperature for coalescing the aggregated particles is changed from 67.5° C. to 74° C.

Preparation of Toner Particles (3)

The toner particles (3) is prepared by using the same method as that in Preparation of toner particles (1) except that the stirring rotation speed in the step of promoting the growth of the aggregated particles is changed from 810 rpm to 520 rpm and the temperature for coalescing the aggregated particles is changed from 67.5° C. to 80° C.

Preparation of Toner Particles (4)

The toner particles (4) is prepared by using the same method as that in preparation of toner particles (1) except that 1.40 parts of nonionic surfactant (manufactured by Rhodia, IGEPAL CA897) is changed to 3.40 parts of anionic surfactant (manufactured by Kao Corp., PELEX SS).

Preparation of Toner Particles (5)

The toner particles (5) are prepared by using the same method as that in Preparation of toner particles (1) except that the temperature for coalescing the aggregated particles is changed from 67.5° C. to 80° C.

Preparation of Toner Particles (6)

100 parts by weight of linear polyester resin (terephthalic acid/ethylene oxide adduct of bisphenol A/linear polyester obtained from cyclohexanedimethanol, glass-transition temperature (Tg): 62° C., number average molecular weight (Mn): 4,000, weight average molecular weight (Mw): 35,000, acid value: 12, hydroxyl value: 25), a mixture of 15 parts by weight of brilliant pigment (manufactured by TOYO ALUMINIUM K.K. 2173EA) is kneaded by using an extruder, pulverized by using a surface-pulverizing type pulverizer, and then the obtained fine particles and coarse particles are classified by using a wind classifier, thereby obtaining toner particles (6).

Preparation of Toner 0.5 parts of titanium compound particles is added to 100 parts of toner particles indicated in Table 1, and mixed by using the HENSCHEL mixer at the peripheral speed of 22 m/s for 3 minutes. Then, sieving is performed with a vibration screen with an aperture of 45 μm so as to prepare the toner used in examples and comparative examples.

Preparation of Carrier

Preparation of Ferrite Particles 1

1,318 parts by weight of $Fe_2O_3$, 586 parts by weight of $Mn(OH)_2$, and 96 parts by weight of $Mg(OH)_2$ are mixed, and the mixture is calcined at a temperature of 730° C. for 3 hours. Then, 6.6 parts by weight of polyvinyl alcohol is added to the calcinated mixture, and dispersed together with 0.2 parts by weight of polycarboxylic acid dispersant, water, and zirconia beads having a media diameter of 1 mm by being ground with a sand mill. The dispersion step is performed until the wet dispersion particle diameter becomes 5.5 μm, and then the particles are granulated and dried by using a spray dryer until the dried particle diameter becomes 38 μmm. Further, the obtained particles go through the grinding step and a magnetic sorting step under the mixed atmosphere which is the gaseous mixture of nitrogen and oxygen having 5% of oxygen partial pressure, then additionally heated at a temperature of 800° C. for 4 hours, and thereby the ferrite particles 1 having the volume average particle diameter ($D_{50}$) of 34 μm are obtained through the classification step.

Preparation of Ferrite Particles 2

The ferrite particles 2 having the particle diameter of 34 μm are obtained by using the same method as that in Preparation of ferrite particles 1 except that 8.5% by weight of titanium oxide with respect to the entire particles is added at the time of mixing the raw materials, and additionally heated under the conditions of the calcination temperature of 810° C., the wet dispersion particle diameter of 1.4 μm, the sintering temperature of 1,420° C., and the mixed atmosphere which is the gaseous mixture of nitrogen and oxygen having 2% of oxygen partial pressure, in the electric furnace at 1,450° C. for 4 hours.

Preparation of Ferrite Particles 3

The ferrite particles 3 having the particle diameter of 28 μm are obtained by using the same method as that in Preparation of ferrite particles 1 except that the dried particle diameter becomes 32 μm by using the spray dryer.

Preparation of Ferrite Particles 4

The ferrite particles 4 having the particle diameter of 50 μm are obtained by using the same method as that in Preparation of ferrite particles 1 except that the dried particle diameter becomes 58 μm by using the spray dryer.

Preparation of Resin Particles 1

- Cyclohexyl methacrylate (CHMA, manufactured by Wako Pure Chemical Industries, Ltd.): 165 parts
- Methyl methacrylate (MMA, methyl methacrylate: manufactured by Wako Pure Chemical Industries, Ltd.): 35 parts
- Aluminum stearate (manufactured by NOF Co., Ltd.): 0.2 parts
- Anionic surfactant (manufactured by Kao Corp., PELEX SS): 0.20 parts The above components are mixed while stirring, and 250 parts of ion exchange water are slowly added to the mixture. After clouding the mixture, the resultant is heated to 70° C. at 5° C./minutes while performing nitrogen substitution, and then is kept to stand while stirring for 15 minutes when the temperature is increased to 70° C. An aqueous solution obtained by dissolving 1.1 parts of ammonium persulfate into 50 parts ion exchange water is slowly added thereto for 30 minutes, and then kept for 7 hours.

After that, cooling is performed, after performing 1) settling the particles by centrifugation, 2) adding 300 parts of ion exchange water and stirring at 25° C. for 30 minutes, and settling the particles six times by repeatedly performing the operations 1) and 2), and the resultant is freeze-dried at 40° C. for 12 hours, thereby obtaining the resin particles 1.

Preparation of Resin Particles 2

The resin particles 2 are obtained by using the same method as that in Preparation of resin particles 1 except that 0.35 parts of anionic surfactant is used.

Preparation of Resin Particles 3

The resin particles 3 are obtained by using the same method as that in Preparation of resin particles 1 except that 200 parts of cyclohexyl methacrylate is used and methyl methacrylate is not used.

Preparation of Carrier 1

As the core particles, 96 parts of ferrite particles 1, 4 parts of coating resin particles 1, and 0.0035 parts of anionic surfactant (manufactured by Kao Corporation, PELEX SS) are pre-mixed at 60 rpm for one hour by using a planetary mixer. After that, the coating layer is formed on the surface of the ferrite particle at 2,000 rpm at approximately 50° C. by using a dry treatment device (NOBIRUTA NOB130, manufactured by Hosokawa Micron Co., Ltd.), and thereby the carrier 1 (carrier particle 1) is obtained.

Preparation of Carriers 2 to 15

The carriers 2 to 15 are prepared by using the same method as that in Preparation of carrier 1 except that the amount of the resin particles, and the types and amount of the surfactants are changed as indicated in Table 1.

Note that, the carrier 6 is prepared by using the same method as that in Preparation of carrier 1 except that 1 part by weight of Mogul L manufactured by Cabot Corp. is developed at the time of the raw material mixed deployment.

In addition, in the carrier 10, ferrite core EF-35 (35B) manufactured by Powder tech Co., Ltd., is used as the ferrite particles. The average particle diameter of the ferrite core EF-35B is 35 μm.

Preparation of Developer 32 parts of toner and 418 parts of carrier are put into a V-blender, are stirred for 20 minutes, and then sieving with a mesh of 212 μm so as to prepare the developer.

Evaluation Test

Evaluation of Color Unevenness

A solid image is formed by the following method.

A developing device of a DOCUCENTRE-III C7600 manufactured by Fuji Xerox Co., Ltd. is filled with a developer that is a sample, a seasoning is performed for one night under the environment of low temperature and low humidity (7% and 10 RH %), and then a solid image (3 cm×4 cm) having a toner amount of 4.0 g/cm$^2$ is continuously formed on 10,000 A4-sized recording sheets (manufactured by Tokushu Tokai Paper Co., Ltd., LETHAC 66) at a fixing temperature of 180° C., a fixing pressure of 4.0 kg/cm$^2$, and a process speed of 120 ppm.

The color unevenness at an end portion of the 10,000th sheet is visually evaluated (six levels).

AA: None of color unevenness

A: Almost none of color unevenness

B: Color unevenness is very slightly found

C: Color unevenness is slightly found

E: Color unevenness is found

F: Color unevenness is clearly found

It should be noted that, in a case of the same score in each evaluation level, any one which obtains a good result is denoted by the suffix of "+".

TABLE 1

| | Toner particles | | | | | Carrier particles | | | | | | | | Surfactant | | | |
|---|---|---|---|---|---|---|---|---|---|---|---|---|---|---|---|---|---|
| | No. | Volume average particle diameter (nm) | Preparation method | C/D | Surfactant | No. | Fluidity (sec/50 g) | Coverage amount (amount of resin particle, part by weight) | Additives | Core No. | Resin particles No. | Resin | Total amount/carrier | Types | Additive amount at the time of producing carrier (part by weight) | Results of evaluation of color unevenness |
| Example 1 | 4 | 12.5 | Emulsion polymerization method | 0.075 | PELEX SS | 1 | 43 | 4 | — | 1 | 1 | CHMA + MMA | 80 ppm | PELEX SS | 0.35 | AA |
| Example 2 | 1 | 12.5 | Emulsion polymerization method | 0.075 | IGEPAL CA897 | 1 | 43 | 4 | — | 1 | 1 | CHMA + MMA | 80 ppm | PELEX SS | 0.35 | A |
| Example 3 | 2 | 13.0 | Emulsion polymerization method | 0.206 | IGEPAL CA897 | 1 | 43 | 4 | — | 1 | 1 | CHMA + MMA | 80 ppm | PELEX SS | 0.35 | A |
| Example 4 | 3 | 12.2 | Emulsion polymerization method | 0.45 | IGEPAL CA897 | 1 | 43 | 4 | — | 1 | 1 | CHMA + MMA | 80 ppm | PELEX SS | 0.35 | A |
| Example 5 | 5 | 12.0 | Emulsion polymerization method | 0.69 | IGEPAL CA897 | 1 | 43 | 4 | — | 1 | 1 | CHMA + MMA | 80 ppm | PELEX SS | 0.35 | A |
| Example 6 | 6 | 12.0 | Knead pulverization method | 0.69 | — | 1 | 43 | 4 | — | 1 | 1 | CHMA + MMA | 80 ppm | PELEX SS | 0.35 | B+ |
| Example 7 | 1 | 12.5 | Emulsion polymerization method | 0.075 | IGEPAL CA897 | 2 | 45 | 4 | — | 1 | 1 | CHMA + MMA | 180 ppm | PELEX SS | 1.35 | B |
| Example 8 | 1 | 12.5 | Emulsion polymerization method | 0.075 | IGEPAL CA897 | 3 | 40 | 4 | — | 1 | 1 | CHMA + MMA | 58 ppm | PELEX SS | 0.13 | B |
| Example 9 | 1 | 12.5 | Emulsion polymerization method | 0.075 | IGEPAL CA897 | 4 | 50 | 4 | — | 1 | 1 | CHMA + MMA | 200 ppm | PELEX SS | 1.55 | C |
| Example 10 | 1 | 12.5 | Emulsion polymerization method | 0.075 | IGEPAL CA897 | 5 | 30 | 4 | — | 1 | 1 | CHMA + MMA | 50 ppm | PELEX SS | 0.05 | C |
| Example 11 | 1 | 12.5 | Emulsion polymerization method | 0.075 | IGEPAL CA897 | 6 | 42 | 6 | Mogul L | 1 | 1 | CHMA + MMA | 80 ppm | PELEX SS | 0.35 | B |
| Example 12 | 1 | 12.5 | Emulsion polymerization method | 0.075 | IGEPAL CA897 | 7 | 41 | 4 | — | 1 | 3 | CHMA | 80 ppm | PELEX SS | 0.35 | C |
| Example 13 | 1 | 12.5 | Emulsion polymerization method | 0.075 | IGEPAL CA897 | 8 | 43 | 4 | — | 1 | 2 | CHMA + MMA | 80 ppm | PELEX SS | — | C |
| Example 14 | 1 | 12.5 | Emulsion polymerization method | 0.075 | IGEPAL CA897 | 9 | 42 | 4 | — | 1 | 1 | CHMA + MMA | 80 ppm | IGEPAL CA897 | 0.35 | B+ |
| Example 15 | 1 | 12.5 | Emulsion polymerization method | 0.075 | IGEPAL CA897 | 10 | 52 | 4.5 | — | 35B | 1 | CHMA + MMA | 80 ppm | PELEX SS | 0.30 | C |
| Example 16 | 1 | 12.5 | Emulsion polymerization method | 0.075 | IGEPAL CA897 | 11 | 28 | 2.5 | — | 1 | 1 | CHMA + MMA | 80 ppm | PELEX SS | 0.52 | C |
| Example 17 | 1 | 12.5 | Emulsion polymerization method | 0.075 | IGEPAL CA897 | 12 | 53 | 4 | — | 1 | 1 | CHMA + MMA | 80 ppm | PELEX SS | 0.35 | C |
| Example 18 | 1 | 12.5 | Emulsion polymerization method | 0.075 | IGEPAL CA897 | 13 | 38 | 4 | — | 1 | 1 | CHMA + MMA | 80 ppm | PELEX SS | 0.35 | A+ |
| Comparative Example 1 | 1 | 12.5 | Emulsion polymerization method | 0.075 | IGEPAL CA897 | 14 | 50 | 4 | — | 1 | 1 | CHMA + MMA | 220 ppm | PELEX SS | 1.75 | E |
| Comparative example 2 | 1 | 12.5 | Emulsion polymerization method | 0.075 | IGEPAL CA897 | 15 | 50 | 4 | — | 1 | 1 | CHMA + MMA | 45 ppm | PELEX SS | — | F |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invent ion and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developer comprising:

a brilliant toner that includes a toner particle having an average equivalent circle diameter D longer than an average maximum thickness C; and a carrier that includes a core particle and a coating layer which covers a surface of the core particle, wherein the coating layer contains a resin and a surfactant, the brilliant toner includes a brilliant pigment that is comprised of a metal powder coated with a metal oxide, the surfactant is at least one selected from the group consisting of sodium alkyl diphenyl ether disulfonate and nonylphenol ethoxylate, and a content of the surfactant is in a range of 50 ppm to 200 ppm with respect to the entire weight of the carrier.

2. The electrostatic charge image developer according to claim 1, wherein the resin has a constituent unit derived from the cycloalkyl (meth)acrylate.

3. The electrostatic charge image developer according to claim 1, wherein a coverage rate of the coating layer is equal to or greater than 80% with respect to the surfaces of the core particles.

4. The electrostatic charge image developer according to claim 1, wherein a ratio (C/D) of the average maximum thickness C to the average equivalent circle diameter D is in a range of 0.001 to 0.700.

5. The electrostatic charge image developer according to claim 1, wherein the brilliant toner contains aluminum as a brilliant pigment.

6. The electrostatic charge image developer according to claim 1, wherein the toner particle contains a surfactant.

7. The electrostatic charge image developer according to claim 6, wherein the surfactant contained in the toner particle is at least one selected from the group consisting of sodium alkyl diphenyl ether disulfonate and nonylphenol ethoxylate.

8. The electrostatic charge image developer according to claim 1, wherein a fluidity of the carrier is in a range of 30 sec/50 g to 50 sec/50 g.

9. A developer cartridge comprising:

a container that contains the electrostatic charge image developer according to claim 1.

10. A process cartridge comprising:

a container that contains the electrostatic charge image developer according to claim 1 and a developer holding member that holds and transfers the electrostatic charge image developer.

* * * * *